US005561919A

United States Patent [19]

Gill

[11] Patent Number: 5,561,919

[45] Date of Patent: Oct. 8, 1996

[54] SANDAL HAVING INDEPENDENTY ADJUSTABLE STRAPS

[76] Inventor: Yoram Gill, P.O. Box 32, Tirat, HaCarmel, Israel

[21] Appl. No.: 195,832

[22] Filed: Feb. 14, 1994

Related U.S. Application Data

[63] Continuation of Ser. No. 936,254, Aug. 27, 1992, abandoned.

[51] Int. Cl.[6] ..... A43B 3/12

[52] U.S. Cl. ..... 36/11.5; 36/44

[58] Field of Search ..... 36/11.5, 71, 88, 36/91, 92, 95, 43, 44, 8.1, 7.5, 50.1, 89

[56] References Cited

U.S. PATENT DOCUMENTS

| | | | |
|---|---|---|---|
| 736,194 | 8/1903 | Bassett | 36/11.5 |
| 1,741,419 | 12/1929 | Jones | 36/43 X |
| 2,259,273 | 10/1941 | Smith | 36/11.5 |
| 2,642,677 | 6/1953 | Yates | 36/11.5 |
| 2,715,285 | 8/1955 | Del Vecchio | 36/11.5 x |
| 2,909,854 | 10/1959 | Edelstein | 36/43 X |
| 2,981,010 | 4/1961 | Aaskov | 36/11.5 |
| 3,086,301 | 4/1963 | Pastor | 36/88 |
| 3,290,081 | 12/1966 | Bente | 36/92 |
| 3,739,501 | 6/1973 | Barrett, Jr. | 36/11.5 |
| 3,800,444 | 2/1974 | Young | 36/11.5 |
| 4,168,585 | 9/1979 | Gleichner | 36/71 x |
| 4,200,997 | 5/1980 | Scheinhaus et al. | 36/11.5 |
| 4,525,940 | 7/1985 | Mochizuki | 36/11.5 |
| 4,742,625 | 5/1988 | Sydor et al. | 36/11.5 |
| 4,793,075 | 12/1988 | Thatcher | 36/11.5 |
| 4,817,302 | 4/1989 | Saltsman | 36/11.5 |
| 4,869,000 | 9/1989 | York, Jr. | 36/11.5 |
| 4,920,664 | 5/1990 | McGregor et al. | 36/11.5 |
| 5,056,241 | 10/1991 | Young | 36/11.5 |
| 5,185,942 | 2/1993 | Decker | 36/11.5 |
| 5,228,216 | 7/1993 | Sargeant | 36/11.5 |

FOREIGN PATENT DOCUMENTS

| | | | |
|---|---|---|---|
| 1163646 | 9/1958 | France | 36/88 |
| 1278689 | 11/1961 | France | 36/11.5 |

*Primary Examiner*—Paul T. Sewell
*Assistant Examiner*—Beth Anne C. Cicconi
*Attorney, Agent, or Firm*—Harness, Dickey & Pierce, P.L.C.

[57] ABSTRACT

A sandal having a sole formed of a lower layer, an intermediate layer having openings formed therein, and a microporous upper layer with the layers sealed together to form air pockets. The sole is fastened upon a user's foot by three, separate, independently adjustable straps. One strap extends over the forward portion of the user's foot, and the other two straps loosely cross each other to extend over the front and rear of the user's ankles for securely holding the sandal in position upon the foot while allowing flexible and comfortable freedom of movement of the foot.

5 Claims, 3 Drawing Sheets

SANDAL HAVING INDEPENDENTY ADJUSTABLE STRAPS

This is a continuation of U.S. patent application Ser. No. 936,254, filed Aug. 27, 1992, now abandoned.

FIELD OF INVENTION

The present invention relates to footwear generally and more particularly to sandals.

BACKGROUND OF THE INVENTION

A great variety of sandals are described in the patent literature. U.S. Pat. No. 736,194 describes a sandal with independently adjustable ankle and toe engagement strap assemblies. U.S. Pat. No. 2,421,818 describes a sandal vamp including multiple straps for retaining a sandal on a wearer's foot, only one of the straps being adjustable. U.S. Pat. No. 2,481,281 describes a sandal with elastic upper elements and U.S. Pat. No. 2,642,677 describes an adjustable counter for strap sandals including two independently adjustable ankle straps and a further independently adjustable toe strap.

U.S. Pat. No. 3,800,444 describes a laced sandal and a relatively rigid heel basket. U.S. Pat. Nos. Des. 94,639 and Des. 166,025 illustrate various strap configurations for shoes and sandals.

U.S. Pat. Nos. 4,584,782 and 4,793,075 describe sport sandals with multi-layer soles and interconnected infinitely adjustable straps.

SUMMARY OF THE INVENTION

The present invention seeks to provide an improved sandal which is designed for maximum wearer comfort and ease of manufacture.

There is thus provided in accordance with a preferred embodiment of the present invention footwear including a sole assembly and an upper assembly mounted onto the sole assembly, the sole assembly including a lowermost sole layer, an intermediate sole layer which is formed with at least one cut-out at the interior thereof and a top sole layer, the sole layers being joined together in sealed engagement to define an air pocket at the at least one cut-out.

In accordance with a preferred embodiment of the invention, the air pocket is defined by the configuration of the cut-out and by the adjacent surfaces of the sole layers laying thereabove and therebelow.

Additionally in accordance with a preferred embodiment of the present invention, there is also provided an arch support disposed between the intermediate sole layer and the top sole layer.

In accordance with a preferred embodiment of the invention, the cut-out is defined by die cutting, preferably in the same operation as the outer configuration of the intermediate sole layer is cut.

Additionally in accordance with a preferred embodiment of the present invention there is provided a sandal including a sole assembly and a strap assembly mounted onto the sole assembly, the strap assembly including first, second and third independent infinitely adjustable straps.

Further in accordance with a preferred embodiment of the present invention there is provided a sandal including a sole assembly including a plurality of strap posts and a single strap sequentially engaging the plurality of strap posts and extending along the top of the foot in a generally zig-zag pattern, whereby tightening of said single strap is operative to provide a tight fit of the sandal onto a wearer's foot.

In accordance with a preferred embodiment one of the strap posts is provided with a clasp for infinitely adjustable engagement with said single strap for tightening thereof.

Additionally in accordance with a preferred embodiment of the present invention, there is provided a sandal including a sole assembly and means for retaining the sole assembly onto a user's foot and wherein the sole assembly includes a microporous top surface formed of a plastic material.

In accordance with a preferred embodiment of the present invention, the microporous top surface is defined by a layer of foamed rubber or plastic from which the top non-porous surface has been removed.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
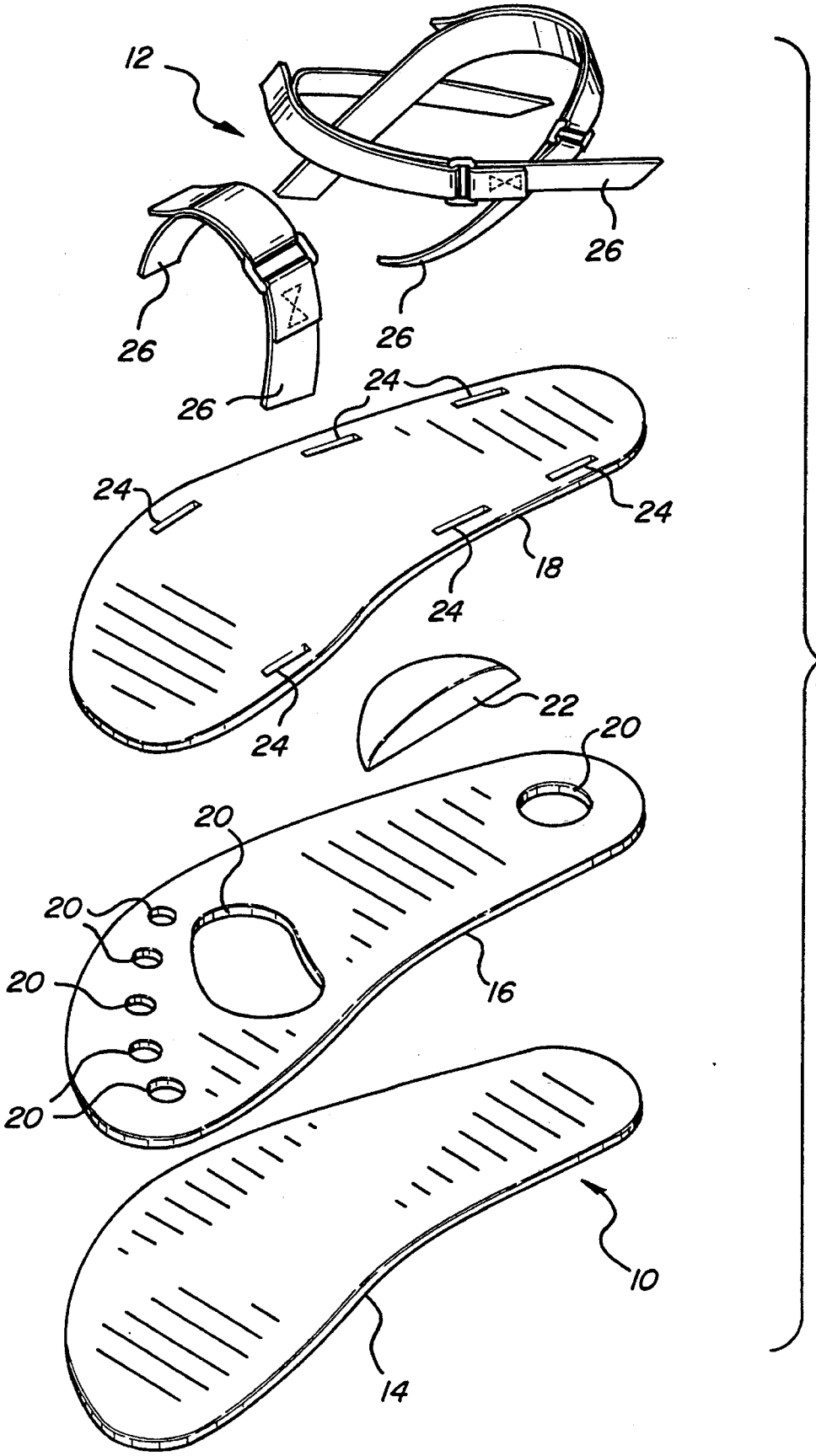
FIG. 1 is an exploded view of an item of footwear constructed and operative in accordance with a preferred embodiment of the present invention.
Figure 2:
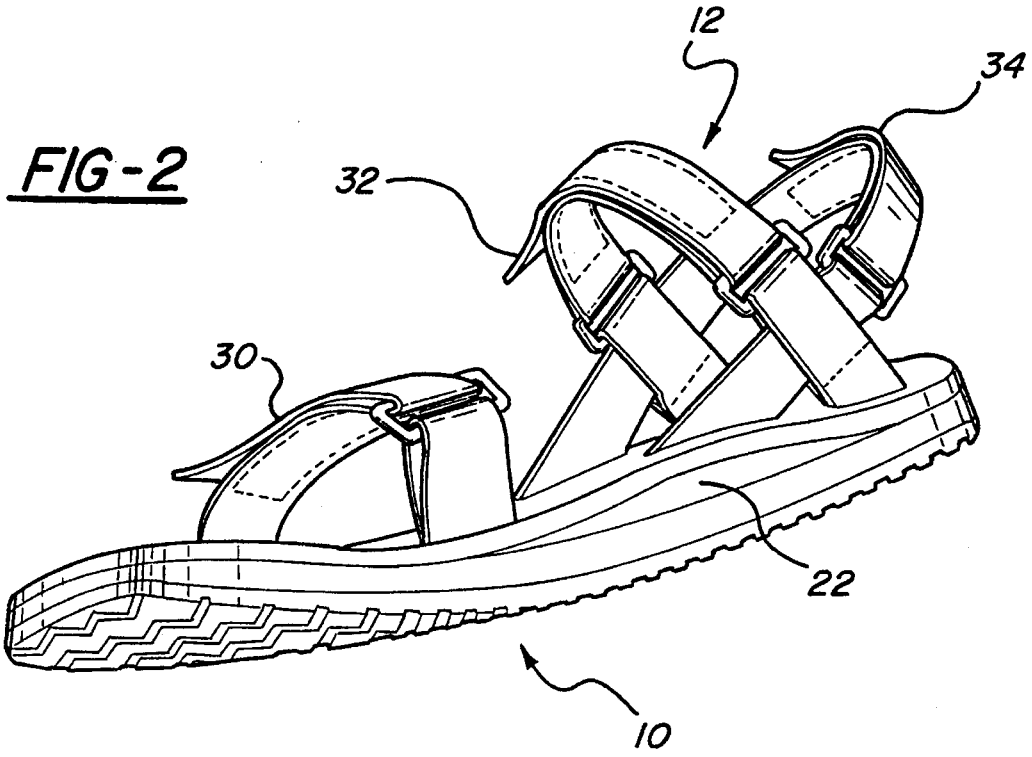
FIG. 2 is a pictorial illustration of another embodiment of footwear.
Figure 2A:
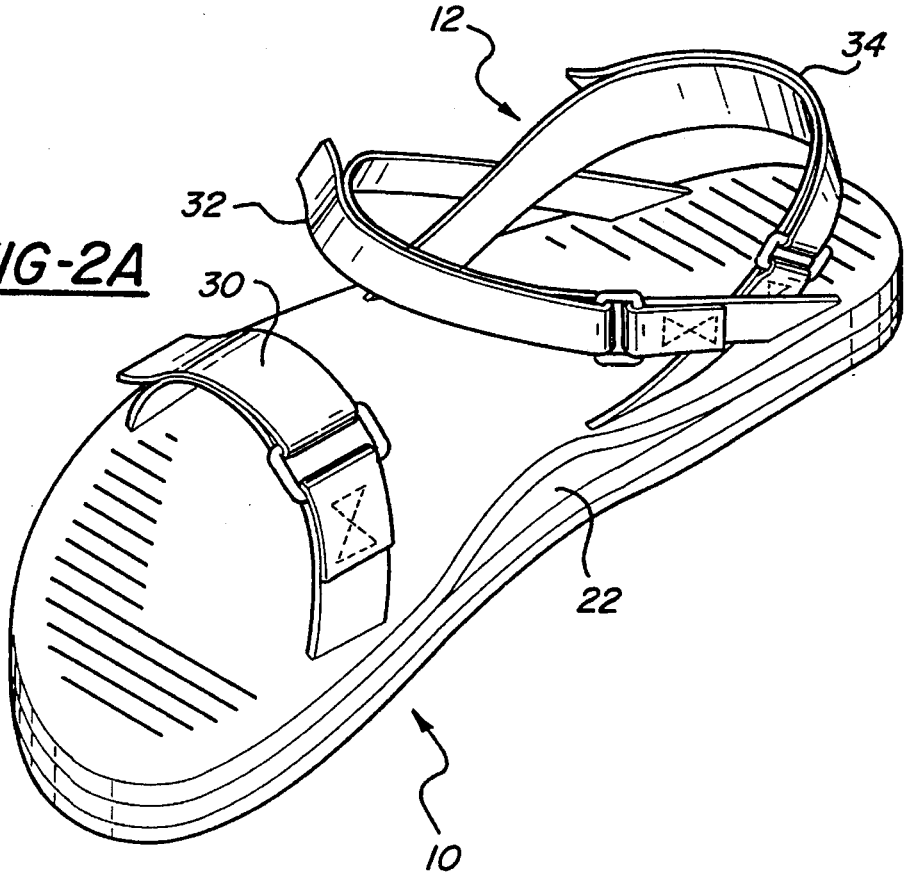
FIG. 2A is a top perspective view of the item of footwear of FIG. 1.

Reference is now made to FIGS. 1 and 2, which illustrate an item of footwear constructed and operative in accordance with a preferred embodiment of the invention. Although the item of footwear illustrated and described herein is a sandal, it will be appreciated that those inventive features described hereinbelow, which are not by their nature limited to sandals, are applicable to any other suitable item of footwear.

As seen in FIGS. 1 and 2, the sandal defines a sole assembly, indicated generally by reference numeral 10, and a foot engagement assembly, indicated generally by reference numeral 12.

In accordance with a preferred embodiment of the present invention, the sole assembly 10 comprises three principal layers 14, 16 and 18. Bottom layer 14 preferably is formed of a high friction resistant plastic material such as EVAA or Neoprene rubber and is formed with a bottom surface which is conditioned for good grip on a support surface. An intermediate layer 16 may be formed of a suitable material, such as a foamed plastic material.

In accordance with a preferred embodiment of the present invention, the intermediate layer 16 is formed with at least one and preferably a plurality of cut-outs 20. Cut-outs 20 are holes extending entirely through the intermediate layer 16 at locations interiorly therewith. Preferably the cut-outs are defined together with the overall configuration of the intermediately layer 16 by die cutting or any other equivalent technique and thus the formation of cut-outs 20 normally does not require any additional step.

One or more additional support elements such as an arch support 22 or a heel support (not shown) may be included in the sole assembly, as shown.

A top layer 18 is preferably formed with apertures 24 for accommodating straps 26 forming part of foot engagement assembly 12. In accordance with a preferred embodiment of the present invention top layer 18 is formed with a microporous top surface. The microporous top surface is preferably achieved by scraping away the existing top surface of conventional foamed plastic materials, such as EVAA rubber at least to a thickness of 0.2 mm.

The three layers 14, 16 and 18 of the sole assembly are sealed together, alone or in combination with additional inserts or additional layers. In accordance with a preferred embodiment of the present invention, intermediate layer 16 is sealed such that each of cut-outs 18 defines a hermetically sealed air pocket. Thus in accordance with a preferred embodiment of the present invention, any suitable desired number of air pockets may be readily defined in the sole assembly substantially without additional manufacturing costs. Accordingly, air pockets may be defined at the region of the individual toes, the ball of the foot and the heel or at any other desired location.

Reference is now made particularly to FIG. 2, which illustrates a preferred strap configuration for a sandal. It is appreciated that although this strap configuration is also shown in FIG. 1, the sole construction described above is not limited to use with sandals or with a particular configuration of sandals shown in FIGS. 1 and 2.

In the embodiment of FIG. 2, the foot engagement assembly 12 comprises three independent straps 30, 32 and 34, each of which is infinitely adjustable and may be formed with a Velcro® fastening. As seen in FIGS. 1 and 2, strap 30 engages the forward foot and toe portion of the foot, while strap 32 engages the front of the ankle and strap 34 engages the back of the ankle. The strap 32 includes a pair of posts with loops which enable passage of strap 34 through the loops such that the straps 32, 34 cross. It is appreciated that the orientation and tightness of each of the steps may be independently set, inasmuch as the straps are not interconnected, as in the prior art.

Figure 3:
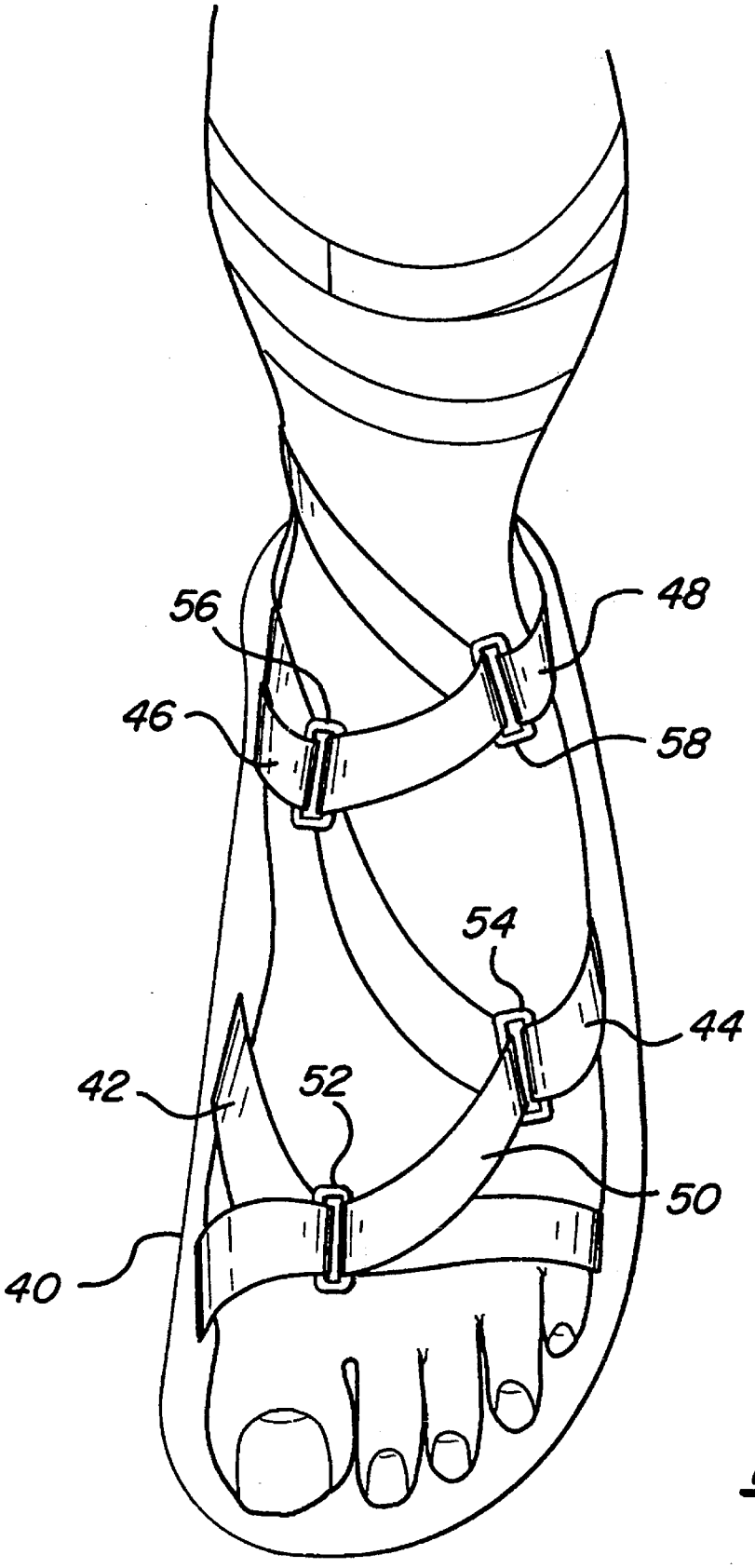
FIG. 3 is a top view illustration of an item of footwear constructed and operative in accordance with another embodiment of the present invention which may include the sole of FIG. 1.

Reference is now made to FIG. 3, which illustrates an alternative embodiment of sandal. The sandal of FIG. 3 preferably includes a sole assembly 40 which is constructed as described above, but may alternatively employ a conventional sole. Retained in the sole assembly 40 are a plurality of strap support posts 42, 44, 46, and 48, which are preferably distributed about the periphery of the sole assembly 40 as shown.

In accordance with a preferred embodiment of the present invention a single strap 50 extends from engagement with a loop 52 associated with post 42, through a loop 54 associated with post 44 and a loop 56, associated with post 46 into adjustable engagement with a buckle 48 associated with post 48. The remainder of the strap 50 may be wound around the wearer's calf as illustrated or otherwise retained as desired.

It is appreciated that the single strap 50, in accordance with a preferred embodiment of the invention is operative to provide desired engagement of the sandal with all relevant regions of the foot, by means of a single tightening and single adjustable engagement. Also, the sole of FIG. 1 may be utilized with the strap configuration illustrated in FIG. 3.

It will be appreciated by persons skilled in the art that the present invention is not limited by what has been particularly shown and described hereinabove. Rather the scope of the present invention is defined only by the claims which follow:

I claim:

1. A sandal comprising:

a sole assembly having a ball, arch and heel area;

a first strap mounted to said sole assembly in said ball area, said first strap including means for independently adjusting said first strap to secure said first strap to a user's foot in the ball area of the foot;

a second strap independent of said first strap and mounted to said sole in said arch area, said second strap including means for independently adjusting said second strap to secure said second strap to the user's foot in the ankle area of the foot, said second strap including a strap portion mounted on the sole assembly, a post mounted on the sole assembly, and a ring connected to the post, said strap portion passing through said ring for enabling said adjustment;;

a third strap independent of said first and second straps and mounted to said sole in said heel area, said third strap including means for independently adjusting said third strap to secure said third strap to the user's foot in the ankle area of the foot;

said third strap including a pair of posts with loops enabling direct passage of said second strap portion through one of said loops and said second strap post through the other of said loops of said third strap such that said second and third straps cross.

2. The sandal according to claim 1 wherein said means for independently adjusting include a hook and loop fastener for enabling adjustment of said straps.

3. The sandal according to claim 1 wherein said first strap includes a first portion having a ring and a second portion including said means for independently adjusting being a hook and loop fastener passing through said ring and tightening upon itself.

4. The sandal according to claim 1 wherein said second strap includes said means for independently adjusting being a hook and loop fastener passing through said ring and tightening upon itself.

5. The sandal according to claim 1 wherein said third strap includes a first ring secured on one of said loops, a second ring secured on the other of said loops and a strap portion including said means for independently adjusting being a hook and loop fastener passing through said rings and tightening upon itself.

* * * * *